US009682305B2

(12) United States Patent
Kim

(10) Patent No.: US 9,682,305 B2
(45) Date of Patent: Jun. 20, 2017

(54) APPARATUS FOR CORRECTING GOLF ADDRESS

(71) Applicant: KRS ELECTRONICS CO., LTD., Seongnam-si, Gyeonggi-do (KR)

(72) Inventor: Yong Hun Kim, Yongin-si (KR)

(73) Assignee: KRS ELECTRONICS CO., LTD., Seongnam-si, Gyeonggi-Do (KR)

( * ) Notice: Subject to any disclaimer, the term of this patent is extended or adjusted under 35 U.S.C. 154(b) by 109 days.

(21) Appl. No.: 14/440,359

(22) PCT Filed: Nov. 6, 2012

(86) PCT No.: PCT/KR2012/009257

§ 371 (c)(1),
(2) Date: May 4, 2015

(87) PCT Pub. No.: WO2014/073713

PCT Pub. Date: May 15, 2014

(65) Prior Publication Data

US 2015/0273309 A1 Oct. 1, 2015

(51) Int. Cl.

*A63B 69/36* (2006.01)
*A63B 24/00* (2006.01)
*A63B 71/06* (2006.01)

(52) U.S. Cl.

CPC ..... *A63B 69/3667* (2013.01); *A63B 24/0006* (2013.01); *A63B 69/3608* (2013.01);
(Continued)

(58) Field of Classification Search

CPC . A63B 69/36; A63B 69/3608; A63B 69/3623; A63B 69/3632; A63B 71/0619;
(Continued)

(56) References Cited

U.S. PATENT DOCUMENTS 5,876,291 A * 3/1999 Dubose ..... A63B 63/00 473/197
6,095,928 A 8/2000 Goszyk
(Continued)

FOREIGN PATENT DOCUMENTS

KR 20-0267556 Y1 3/2002
KR 10-2004-0072160 A 8/2004
(Continued)

OTHER PUBLICATIONS

International Search Report for PCT/KR2012/009257 mailed May 15, 2013 from Korean Intellectual Property Office.

*Primary Examiner* — Raleigh W Chiu
(74) *Attorney, Agent, or Firm* — Revolution IP, PLLC

(57) ABSTRACT

An apparatus for correcting a golf address to be adhered to the body of a user, including: an input module in which the user pushes an input button to set a target azimuth while looking at a target point in a user setting mode; an azimuth calculation module comprising an accelerometer for measuring gravity direction, a gyroscope for measuring the x-axis, y-axis and z-axis directions of a golf club face, and a calculation processor for calculating the address azimuth of the user with respect to the target azimuth set in the input module by using the values measured at the accelerometer and the gyroscope when the user is in an address posture in a user execution mode; and an output module for outputting the address azimuth calculated at the azimuth calculation module.

5 Claims, 1 Drawing Sheet

(52) U.S. Cl.
CPC ..... *A63B 69/3623* (2013.01); *A63B 69/3632* (2013.01); *A63B 71/0619* (2013.01); *A63B 2071/0625* (2013.01); *A63B 2071/0694* (2013.01); *A63B 2208/0204* (2013.01); *A63B 2220/16* (2013.01); *A63B 2220/40* (2013.01); *A63B 2220/44* (2013.01); *A63B 2220/72* (2013.01); *A63B 2220/83* (2013.01)

(58) Field of Classification Search
CPC ..... A63B 53/00; A63B 24/00; A63B 24/0006; A63B 71/06; A63B 2220/16; A63B 2220/40; A63B 2220/72; A63B 69/3667; A63B 2071/0625; A63B 2071/0694; A63B 2220/44; A63B 2220/83; G01B 7/00

See application file for complete search history.

(56) References Cited

U.S. PATENT DOCUMENTS

2007/0206837 A1* 9/2007 Kirby ..... A63B 24/0003 382/107
2009/0036237 A1* 2/2009 Nipper ..... A63B 24/0021 473/409
2009/0291770 A1* 11/2009 You ..... A63B 69/3608 473/207
2011/0224012 A1* 9/2011 Hashimoto ..... A63B 69/3632 473/223
2012/0277890 A1* 11/2012 Han ..... A63B 69/3623 700/91
2013/0138413 A1* 5/2013 Finch ..... G06F 17/5009 703/6
2013/0267339 A1* 10/2013 Boyd ..... A63B 69/36 473/223
2014/0073446 A1* 3/2014 Davenport ..... A63B 24/0006 473/223
2015/0273309 A1* 10/2015 Kim ..... A63B 69/3608 473/207
2015/0283428 A1* 10/2015 Shibuya ..... G01P 13/00 473/221
2016/0151696 A1* 6/2016 Chen ..... A63B 69/3614 473/199

FOREIGN PATENT DOCUMENTS

KR 10-0722870 B1 5/2007
KR 10-1161558 B1 7/2012

* cited by examiner

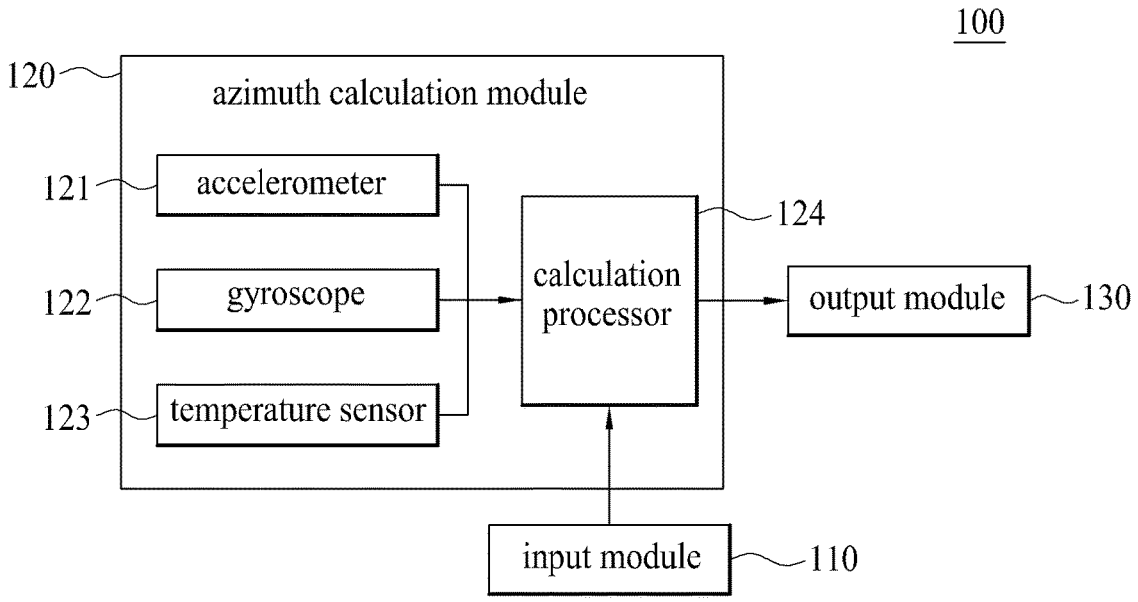
100
120
azimuth calculation module
121
accelerometer
122
gyroscope
123
temperature sensor
124
calculation processor
output module
130
input module
110

APPARATUS FOR CORRECTING GOLF ADDRESS

CROSS REFERENCE TO PRIOR APPLICATIONS

This application is a National Stage Application of PCT International Patent Application No. PCT/KR2012/009257 filed on Nov. 6, 2012, under 35 U.S.C. §371, which is hereby incorporated by reference in its entirety.

TECHNICAL FIELD

The present invention relates to an apparatus helping to correct golf address.

BACKGROUND ART

Golf beginners or golfers who try to adapt to an uneven field have difficulties in taking an address posture, which is the most basic element of golf.

Golfers should be positioned at address such that a target point is perpendicular to a golfer's point of view. However, the angle is not readily perpendicular and tends to be slightly deflected, and in such a posture, golfers hit the golf ball out of the target point.

In particular, golfers tend to address the ball in a completely wrong direction because of an uneven field or an optical illusion caused by the surrounding environment.

Therefore, an apparatus intended to aid a golfer in maintaining a correct address posture even in varying surroundings is required.

DISCLOSURE

Technical Problem

An object of the present invention is to provide an apparatus for correcting golf address.

Technical Solution

In order to accomplish the above object, the present invention provides an apparatus for correcting golf address, attached to the user's body and including an input module in which a user sets a target azimuth by pushing an input button while facing a target point in a user setting mode; an azimuth calculation module including an accelerometer measuring the direction of gravity, a gyroscope measuring X-, Y- and Z-axis directions of a golf club face, and a calculation processor using the values measured by the accelerometer and the gyroscope to calculate an address azimuth of the user with respect to the target azimuth set at the input module when the user takes an address posture in a user execution mode; and an output module outputting the address azimuth calculated by the azimuth calculation module.

Here, the output module may display the address azimuth calculated by the calculation processor using an LED/LCD.

The input module may receive an input of an address azimuth reference the user desires from the user in the user setting mode, and the output module may be configured to let the user know by sound alarm or LED/LCD indication when the address azimuth calculated by the azimuth calculation module becomes the address azimuth reference set at the input module, while the user takes an address posture in the user execution mode.

The azimuth calculation module may further include a temperature sensor for measuring temperature.

Meanwhile, the calculation processor may use the temperature measured by the temperature sensor to correct an error of the values measured by the accelerometer and the gyroscope.

In addition, the calculation processor may calibrate the accelerometer and the gyroscope according to the user's input in the user setting mode in order to increase accuracy of the accelerometer and the gyroscope.

Advantageous Effects

According to the aforementioned apparatus for correcting golf address, an address azimuth of a user with respect to a target azimuth toward a target point is measured using the accelerometer and the gyroscope, thereby allowing the user to know whether the address azimuth of the user is perpendicular or a desired address azimuth is obtained. Accordingly, the user can keep a correct address posture. Further, it is possible to correct various sensor values by using the temperature sensor. In addition, it is possible to increase accuracy by calibrating the accelerometer or the gyroscope even without a temperature sensor.

BRIEF DESCRIPTION OF THE DRAWINGS

FIG. 1 is a block diagram showing an apparatus for correcting golf address according to an exemplary embodiment of the present invention.

BEST MODE FOR THE INVENTION

Exemplary embodiments of the invention are capable of various modifications and alternative forms, and particular embodiments are illustrated by way of examples in the drawing and will herein be described in detail. It should be understood, however, that there is no intent to limit exemplary embodiments of the present invention to the particular embodiments. On the contrary, exemplary embodiments are to cover all modifications, equivalents and alternatives which fall within the spirit and scope of the present invention. Like reference numerals refer to like elements in describing the drawing.

Terms such as first, second, A, B, etc., may be used herein to describe various elements, but the elements should not be limited by these terms. These terms are used only to distinguish one element from another. For example, a first element could be termed a second element, and similarly, a second element may be termed a first element, without departing from the scope of the present invention. As used herein, the term "and/or" includes any and all combinations of one or more of the associated listed items.

It should be understood that when an element is described to be "connected" or "coupled" to another element, it should be understood that it can be connected or coupled directly to the other element or an intervening element may be present. On the other hand, when an element is described to be "directly connected" or "directly coupled" to another element, it should be understood that no intervening element is present.

The terms used herein are for describing specific embodiments only and are not intended to limit the present invention. As used herein, the singular forms should be construed to include the plural forms as well, unless the context clearly indicates otherwise. As used herein, terms such as "comprise," "include," etc., are only to specify the presence of described features, numbers, steps, operations, elements, parts, or a combination thereof, but do not preclude the presence or addition of one or more other features, numbers, steps, operations, elements, parts, or a combination thereof.

Unless otherwise defined, all terms including technical and scientific terms used herein have the same meaning as commonly understood by one of ordinary skill in the art to which the present invention belongs. It will be further understood that terms defined in commonly used dictionaries should be interpreted as having a meaning that is consistent with their meaning in the context of the relevant art and will not be interpreted in an idealized or overly formal sense unless expressly so defined herein.

Hereinafter, a preferred exemplary embodiment according to the present invention is described in detail with reference to the accompanying drawing.

FIG. 1 is a block diagram showing an apparatus for correcting golf address according to an exemplary embodiment of the present invention.

Referring to FIG. 1, the apparatus 100 for correcting golf address according to an exemplary embodiment of the present invention (hereinafter, referred to as 'golf address correcting apparatus') may include an input module 110, an azimuth calculation module 120 and an output module 130. The azimuth calculation module 120 may include an accelerometer 121, a gyroscope 122, a temperature sensor 123, and a calculation processor 124.

The golf address correcting apparatus 100, which is attached to the user's body (hat, waist, etc.), measures an address azimuth of the user with respect to a target azimuth towards a target point to help the user to maintain the address angle at 90°. Or, the apparatus has a user calibration function helping him or her to maintain an address azimuth at a desired angle, for example, 85°, 95°, etc., without being limited to 90°. The golf address correcting apparatus 100 may include a display panel so as to confirm an address azimuth that may vary constantly.

Hereinafter, details of the constitution will be described.

Next, the input module 110 may be configured such that the user sets a target azimuth in a user setting mode by pushing an input button while facing the target point. In other words, the target azimuth can be set if the user inputs an instruction through the input module 110 while facing the target point. The input module 110 may be used for inputting a reset instruction.

Meanwhile, the input module 110 may be configured to receive an input of an address azimuth reference the user desires from the user in the user setting mode. The address azimuth reference, which may be referred to as a contained angle with the target azimuth, indicates an azimuth of direction the user faces when the user takes an address posture.

Here, the address azimuth reference indicates a desired address azimuth when the user takes the address posture. The address azimuth is preferably 90°, but users trained to some extent tend to swing according to address azimuth that fits for them. For example, the address azimuth may be 85° or 95°. Accordingly, users may preset a most suitable address azimuth reference.

The azimuth calculation module 120 is attached to the user's trunk, particularly to waist, and determines whether the address azimuth of the user is perpendicular to the target azimuth of the target point. The azimuth calculation module 120 uses the accelerometer 121 and the gyroscope 122 to first set a target azimuth of a target point and then measure the address direction of the user, thus calculating the address azimuth.

Here, the accelerometer 121 is configured to measure the direction of gravity. The accelerometer 121 is constituted using the same principle as a pendulum on a frame and measures the gravity direction and z-axis direction.

The gyroscope 122 measures x-axis, y-axis and z-axis directions of a golf club face. The gyroscope 122 is constituted with a rotor in a gimbal structure and measures the rotation or inclination with respect to each of the three-dimensional axis directions. The gyroscope 122 can sense three dimensional rotation or movement, and particularly, accurately sense the direction of an azimuth. Also, the gyroscope 122 can accurately calculate an azimuth even on a slope in a field.

The temperature sensors 123 measures temperature, which is for correcting errors of the values measured by the accelerometer 121 and the gyroscope 122 according to the temperature.

The calculation processor 124 uses the values measured by the accelerometer 121 and the gyroscope 122 to calculate the address azimuth of the user with respect to the target azimuth, in the user execution mode.

Meanwhile, the calculation processor 124 may correct an error of the values measured by the accelerometer 121 and the gyroscope 122 using the temperature measured by the temperature sensor 123. Also, the calculation processor 124 may be configured to calibrate the accelerometer 121 and the gyroscope 122 according to the user's input in the user setting mode, so as to increase accuracy of the accelerometer 121 and the gyroscope 122.

Next, the output module 130 may be configured to output the address azimuth calculated by the azimuth calculation module 120. Here, the output module 130 may indicate an angle by a number through a panel such as LED/LCD, etc., or produce a sound or light output when the angles become perpendicular.

Meanwhile, the output module 130 may be configured to let the user know by sound alarm or LED/LCD indication when the address azimuth calculated by the azimuth calculation module 120 becomes the address azimuth reference set at the input module 110, while the user takes the address posture in the user execution mode. In other words, the output module 130 may output sound alarm or LED/LCD indication at the user's desired address azimuth.

While the present invention has been described with respect to the aforementioned embodiments, it will be apparent to those skilled in the art that various changes and modifications may be made without departing from the spirit and scope of the invention as defined in the following claims.

The invention claimed is:

1. An apparatus for correcting golf address set up comprising stance, posture and alignment, the apparatus being attached to a user's body, the apparatus comprising:

an input module configured to receive a target azimuth set by a user setting mode, the target azimuth being set while facing a target point;

in response to detection of a user takes an address posture, an azimuth calculation module comprising an accelerometer configured to measure a direction of gravity, a gyroscope configured to measure X-, Y- and Z-axis directions of a golf club face, and a calculation processor, using values measured by the accelerometer and the gyroscope, to calculate an address azimuth of the user with respect to the target azimuth set at the input module; and an output module configured to output the address azimuth calculated by the azimuth calculation module, wherein the user can adjust golf address set up using the output address azimuth, and wherein the calculation processor is further configured to calibrate the accelerometer and the gyroscope according to a plurality of target azimuth set by the user setting mode in order to increase accuracy of the accelerometer and the gyroscope.

2. The apparatus of claim 1, wherein the output module displays the address azimuth calculated by the calculation processor using an LED/LCD.

3. The apparatus of claim 1, wherein the input module receives an input of an address azimuth reference, the address azimuth references varies from the user in the user setting mode, and the output module is configured to make sound alarm or to display LED/LCD indication in response to detection of the address azimuth calculated by the azimuth calculation module becomes the address azimuth reference set by the input module, while the user takes the address posture.

4. The apparatus of claim 3, wherein the azimuth calculation module further comprises a temperature sensor to measure temperature.

5. The apparatus of claim 4, wherein the calculation processor uses the temperature measured by the temperature sensor to correct an error of the values measured by the accelerometer and the gyroscope.

* * * * *